US008616121B1

(12) United States Patent
Hansalik

(10) Patent No.: US 8,616,121 B1
(45) Date of Patent: Dec. 31, 2013

(54) COOKTOP DRAIN

(76) Inventor: Paul Hansalik, Staten Island, NY (US)

( * ) Notice: Subject to any disclaimer, the term of this patent is extended or adjusted under 35 U.S.C. 154(b) by 362 days.

(21) Appl. No.: 13/041,649

(22) Filed: Mar. 7, 2011

Related U.S. Application Data

(60) Provisional application No. 61/316,178, filed on Mar. 22, 2010.

(51) Int. Cl.
*A47J 37/12* (2006.01)

(52) U.S. Cl.
USPC ..... 99/410; 99/407; 99/415; 99/418

(58) Field of Classification Search
USPC ..... 99/407, 410, 415, 418
See application file for complete search history.

(56) References Cited

U.S. PATENT DOCUMENTS

| | | | | | |
|---|---|---|---|---|---|
| 2,758,588 | A * | 8/1956 | Lozano | 126/1 R |
| 3,958,503 | A * | 5/1976 | Moore | 99/327 |
| 4,084,492 | A * | 4/1978 | Sullivan | 99/330 |
| 4,569,277 | A * | 2/1986 | Stiglich | 99/330 |
| 4,574,688 | A * | 3/1986 | Barbieri | 99/330 |
| 4,741,261 | A * | 5/1988 | DiMaria | 99/330 |
| 4,803,917 | A * | 2/1989 | Barbieri | 99/356 |
| 5,123,337 | A * | 6/1992 | Vilgrain et al. | 99/483 |
| 5,313,876 | A * | 5/1994 | Hilger et al. | 99/330 |
| 5,385,084 | A * | 1/1995 | Laibson | 99/411 |
| 5,588,352 | A * | 12/1996 | Harrison | 99/339 |
| 5,630,359 | A * | 5/1997 | Stein | 99/407 |
| 5,642,660 | A * | 7/1997 | Killgore et al. | 99/403 |
| 5,758,569 | A * | 6/1998 | Barbour | 99/415 |
| 5,826,494 | A * | 10/1998 | Wang | 99/340 |
| 5,896,810 | A * | 4/1999 | Barbour | 99/415 |
| 6,063,421 | A * | 5/2000 | Barravecchio | 426/231 |
| 6,182,305 | B1 * | 2/2001 | O'Connell et al. | 4/631 |
| 6,192,791 | B1 * | 2/2001 | Baker et al. | 99/403 |
| 6,269,737 | B1 * | 8/2001 | Rigney et al. | 99/339 |
| 6,314,869 | B1 * | 11/2001 | Bourgeois, Jr. | 99/340 |
| 6,446,545 | B2 * | 9/2002 | Rigney | 99/339 |
| 6,532,865 | B1 * | 3/2003 | Hoffman | 99/407 |
| 6,568,314 | B1 * | 5/2003 | Stepanova | 99/340 |
| 6,626,090 | B2 * | 9/2003 | McLemore et al. | 99/340 |
| 6,748,851 | B2 * | 6/2004 | Hoffman | 99/407 |
| 6,820,536 | B2 * | 11/2004 | Kijimoto | 99/330 |
| 7,604,001 | B2 * | 10/2009 | Craghead | 126/211 |
| 7,640,848 | B1 * | 1/2010 | Bourgeois | 99/340 |
| 7,886,656 | B2 * | 2/2011 | Saltini | 99/331 |
| 8,067,716 | B1 * | 11/2011 | Lloyd | 219/439 |
| 8,359,972 | B2 * | 1/2013 | Palmer et al. | 99/403 |
| 2001/0054358 | A1 * | 12/2001 | Rigney | 99/403 |
| 2004/0216620 | A1 * | 11/2004 | Quiggins et al. | 99/413 |

(Continued)

*Primary Examiner* — Joseph M Pelham
*Assistant Examiner* — Jimmy Chou
(74) *Attorney, Agent, or Firm* — Goldstein Law Offices, P.C.

(57) ABSTRACT

A cooktop drain that heats liquid in a stockpot and empties the hot liquid directly down a drain. The cooktop sits in at countertop level over a sink and a valved stockpot sits on the cooktop. The sink, cooktop and stockpot are assembled such that heating, draining the stockpot of liquid and rinsing any residue are performed by a single apparatus without having to transport and tip the stockpot. The cooktop drain has a burner underneath a grate, and the stockpot has a bottom valve connecting to an integrated funnel leading directly to the sink directly beneath the grate and the drain, bypassing the burner, disposing of heated water directly through the valve and integrated funnel into the sink and down the drain. The cooktop drain has a rinse head in the sink that rinses any food residue a clean, fresh smelling sink under the grate without removing the burner.

9 Claims, 7 Drawing Sheets

(56) References Cited

U.S. PATENT DOCUMENTS

2005/0076793 A1* 4/2005 Sizer ..... 99/403
2006/0157361 A1* 7/2006 Weaver ..... 206/321
2006/0272633 A1* 12/2006 Osias ..... 126/383.1
2010/0107898 A1* 5/2010 Vadevoulis ..... 99/404

* cited by examiner

COOKTOP DRAIN

CROSS-REFERENCE TO RELATED APPLICATIONS

This application is a nonprovisional utility application of provisional patent application Ser. No. 61/316,178 filed in the United States Patent Office on Mar. 22, 2010 and claims the priority thereof.

BACKGROUND OF THE INVENTION

The invention relates generally to a cooktop drain that heats water in a stockpot and empties the water directly down a drain. More particularly, the invention relates to a drain, having a cooktop and a valved stockpot and to a sink connected to the drain, the sink having a rinse assembly. The sink, cooktop and stockpot are assembled such that heating, draining the stockpot of water into the sink and rinsing the sink of residue are performed by a single apparatus.

Today's residential and commercial kitchens use a cooking surface commonly known as a cooktop that is either independently installed on top of a counter surface or integrated into the top section of an oven range configuration. These appliances, having electric or gas heat sources, commonly have one or more burners along a flat grated cooking surface. A typical use for a cooktop is to heat water to boil or steam starchy foods such as pasta or rice or vegetables. This common task requires the cook to manually fill a pot with water at one location, typically a sink, transport the pot to the cooking area, boil the water, and when finished, lift the pot off the cooktop surface, and carry the vessel over to the sink to drain the water by tipping the pot over and expelling the hot liquid contents.

In this sequence of events, the cook must first fill the pot and then lift and manually transport it from the sink to the cooktop. With the emergence of backsplash or countertop faucets and hoses positioned above or adjacent to the cooktop in commercial and residential kitchen settings, pots can now be easily filled at the site of heating. While these filling devices conveniently resolve the issue of transporting a water laden pot from one location to another, the pot still requires the water to be drained manually in order for its food contents to be removed. Several convenience and safety issues arise as a result of these common tasks. The pot is heavy and unwieldy when full of water, making it difficult to lift to and from a sink. There is a danger from steam and scalding water, especially when the pot is transported back to the sink and emptied as the water and steam are expelled. The danger is acute if the user drops the pot during transportation, potentially scalding the user as well as bystanders. Many handicapped persons find these tasks physically challenging.

Both in commercial and residential kitchen settings, the frequent task of filling a pot with water, boiling the water, and draining the pot becomes an inconvenience and safety concern. Many have proposed devices that consolidate some of these tasks within one appliance, thus increasing the convenience and speed of these tasks.

Cooking pasta on demand in industrial settings has led to large spaghetti cookers that use vats of water with a heat source underneath and a drain. The pasta is submerged into the hot water inside a basket or similar device. Some recirculate or refresh the water, some have automated the task of maintaining the water level by adding more heated water through a valved pipe. Some have a separate vat of cool water to stop the pasta from overcooking. Some have added chutes to add pre-measured amounts of pasta.

Others have developed pots with bottom spouts, sometimes with a filter, especially for deep fryers that use hot oil. One even proposed a pot with a bottom spout for use outdoors. None of the these provide drains to dispose of the hot liquid, particularly those for deep fryers, since oil should not be drained to the sewer system. If the pot contains hot water, it must be transported to the sink and emptied through the bottom spout, which eliminates the tipping step, but not the transportation step.

Others have attempted to integrate a sink, a sunken cooking chamber and a cutting board to save the user steps. Others have place cook tops elevated with a sink at a lower level so that the cooktop can easily be cleaned and the cleaning fluid falling into the sink drain. One has proposed having heaters attached to the bottom of a sink and using the sink basin as a cooking pot.

While these units may be suitable for the particular purpose employed, or for general use, they would not be as suitable for the purposes of the present invention as disclosed hereafter.

SUMMARY OF THE INVENTION

It is an object of the invention to produce a cooktop drain that heats food in a pot sitting at a countertop level. Accordingly, the cooktop drain has a cooking grate at the countertop level, supporting the pot at countertop level when the food is heating.

It is another object of the invention to produce a cooktop drain that has a heat source adjacent to a countertop level. Accordingly, the cooktop drain has a burner underneath a cooking grate, the cooking grate placed at the countertop level.

It is a further object of the invention to produce a cooktop drain that drains heated water in a pot directly into a sanitary sewer system without carrying the pot to a sink. Accordingly, the cooktop drain has a sink with a drain pipe directly beneath the cooktop for disposing of heated water directly when the pot sitting on the cooktop is emptied into the sink.

It is yet another object of the invention to produce a cooktop drain that empties heated water from a pot sitting on a grate of the cooktop without tipping the pot into a sink. Accordingly, the cooktop drain has an integrated funnel and a pot with a bottom valve connecting to the integrated funnel, the integrated funnel leading directly to a sink with a drain directly beneath the grate, the cooktop drain disposing of heated water directly through the valve and integrated funnel into the sink when the pot sits on the grate.

It is yet another object of the invention to produce a cooktop drain that maintains a clean, fresh smelling sink under the grate without removing the cooktop plate. Accordingly, the cooktop drain has a rinse head in the sink that rinses any food residue into a drain pipe connected to the sanitary sewer system.

The invention is a cooktop drain that heats liquid in a stockpot and empties the hot liquid directly down a drain. The cooktop sits at countertop level over a sink and a valved stockpot sits on the cooktop. The sink, cooktop and stockpot are assembled such that heating, draining the stockpot of liquid and rinsing any residue are performed by a single apparatus without having to transport and tip the stockpot. The cooktop drain has a burner underneath a grate, and the stockpot has a bottom valve connecting to an integrated funnel leading directly to the sink directly beneath the grate and the drain, bypassing the burner, disposing of heated water directly through the valve and integrated funnel into the sink and down the drain. The cooktop drain has a rinse head in the sink that rinses any food residue, producing a clean, fresh smelling sink under the grate without removing the burner.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
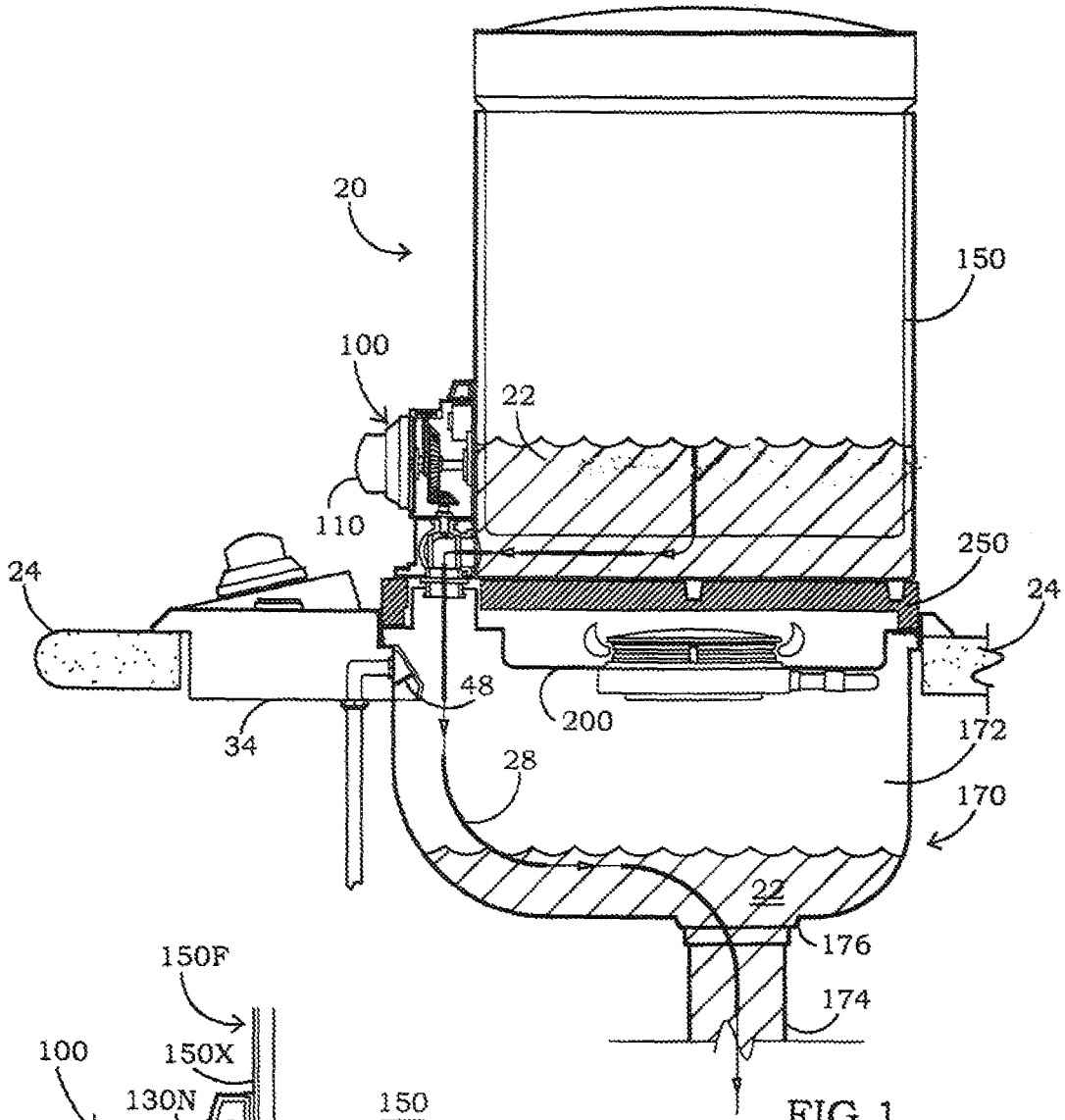
FIG. 1 is a cross-sectional side elevational view of the invention.

FIG. 1 illustrates a first embodiment of a cooktop drain 20 with a stockpot 150 having a drainage assembly 100 seated on a burner plate 200 above a sink 170. In this embodiment, the cooktop drain 20 is installed in a countertop 24. Note that the term "countertop" as used herein, provides a plane of reference for the various components of the present invention, can be at any reasonable height, and need not provide usable counter space. A user cooks food in water 22 in the stockpot 150 with heat provide by the burner plate 200. When cooking is finished, the user drains the scalding water 22 through the drainage assembly 100 following a path 28 flowing directly into the sink 170, the sink having a sink body 172, and down a connected drain pipe 174 without having to lift, carry or tilt the heavy stockpot 150 to empty the scalding hot water 22. The stockpot 150 sits on a grate 250 and the drainage assembly 100 allows the water 22 to flow through the grate 250 without contacting the burner plate 200. After the stockpot 150 empties, a rinse head nozzle 48 connected to potable water and placed inside the sink body 172 washes away any food residue to maintain an odorless and clean sink 170.

Figure 7:
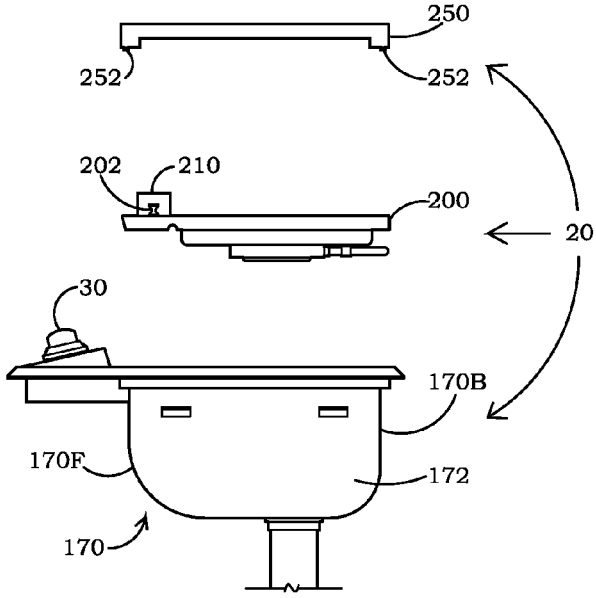
FIG. 7 is an exploded side elevational view of the invention.

FIG. 7 shows the cooktop drain 20 in an exploded view. The stockpot 150 has a body 152 with a pair of vertical handles 154 and the attached drainage assembly 100. The stockpot 150, having a top 150T, a bottom 150B, an interior and an exterior, also has a removable lid 162 on the top and a removable strainer 156 in the interior. The strainer 156 is replaceable with other cooking utensils such as, for example, but not limited to, a steamer basket or a smaller pot inserted towards the top of the stockpot, forming a double boiler. The stockpot 150, having a plurality of set pins 160, sits atop the grate 250 above the burner plate 200 on the set pins 160. The burner plate has 200 an integrated funnel 210 connecting through a bore in the grate 250, illustrated in other drawings, to the drainage assembly 100. The burner plate 200 has an integrated funnel 210 creating a passage to the sink body 172. The drainage assembly 100 empties into the sink body 172 through the grate 250, the grate 250 having the bore for the drainage assembly to connect to the integrated funnel 210 and into the sink body. The sink 170 has a back 170B and a front 170F. The burner plate 200 hingedly attaches to the back 170B of the sink body 170. A burner plate control assembly 30 is mounted on the sink front 170F.

Figure 4:
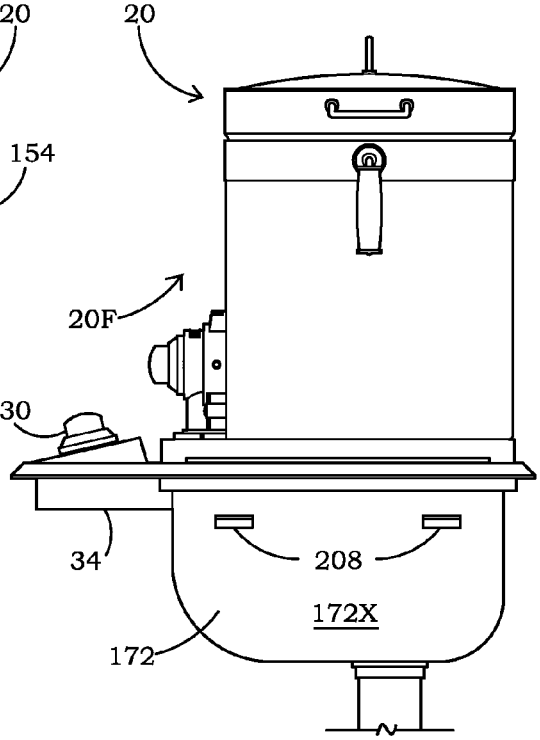
FIG. 4 is a side elevational view of the invention.

FIG. 4 shows the assembled invention 20 from the side. The sink body 172 has an exterior surface 172X with a plurality of countertop mounting clips 208 to fix the cooktop drain 20 in the countertop 24 having a cutout to accommodate the cooktop drain 20. The cooktop drain 20 has a front 20F and attached to the front 20F of the cooktop drain is an apron 34. On the apron 34 is the burner control assembly 30 as well a pair of openings, a first opening for a rinse head actuator and a second opening for a filler head.

Figure 3:
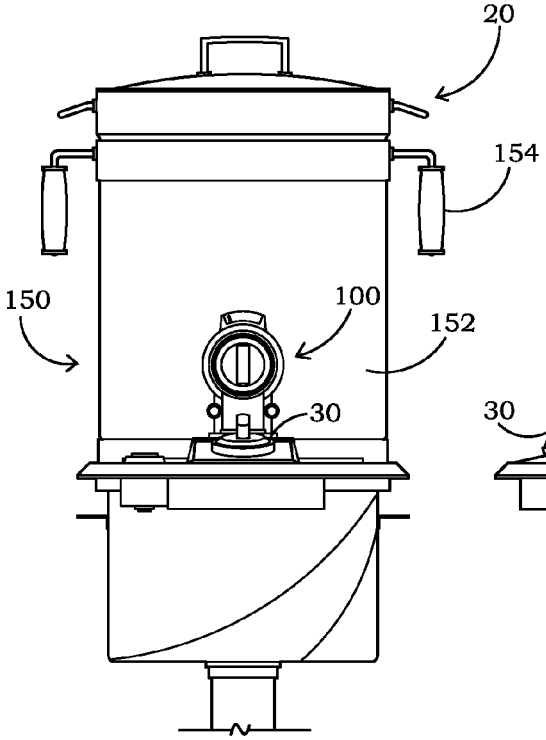
FIG. 3 is a front elevational view of the invention.

FIG. 3 shows the invention 20 from the front with the drainage assembly housing 100 mounted above the cook plate control assembly 30. The stockpot body 152, having a left side and a right side, has the pair of inverted vertical handles 154 mounted on each side for aligning the stockpot 150 properly on the grate 250, the vertical handles 154 easier to grasp when rotating the stockpot 150.

Figure 5:
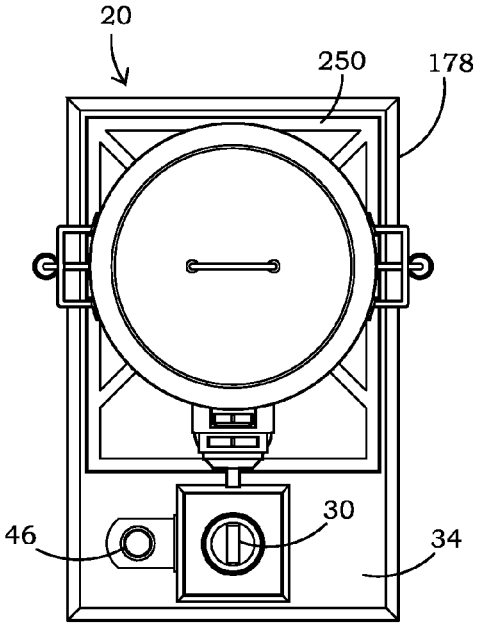
FIG. 5 is a top plan view of the invention.

In a top plan view, FIG. 5 shows the apron 34 with the burner control assembly 30 and an opening 46 for the rinse head assembly 40. The apron 34 continues around the grate 250, forming a rim 178 that mounts on the countertop, sealing the cutout with the cooktop drain 20 in place.

Figure 6:
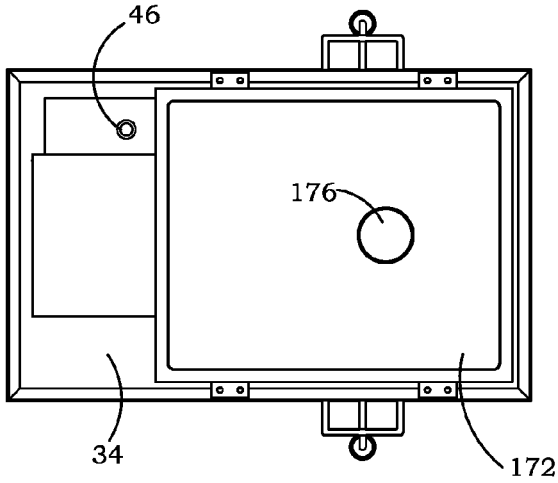
FIG. 6 is a bottom plan view of the invention.
Figure 6A:
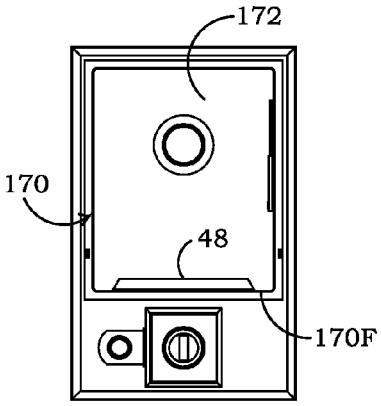
FIG. 6A is a top plan view of a sink and an apron of the invention.

In a bottom plan view, FIG. 6 shows an opening 176 in the sink body 172 for the drain pipe as well the opening 46 for the rinse head assembly in the apron 34. FIG. 6A shows a top plan view of the sink body 172. Inside the front of the sink body 172 is a rinse head spray nozzle 48. In this drawing, the nozzle 48 extends along of the front 170F of the sink with a guide directing the spray downwards. It is understood that this is a non-limiting example and that other configurations of spray nozzles are possible within the inventive concept.

Figure 2:
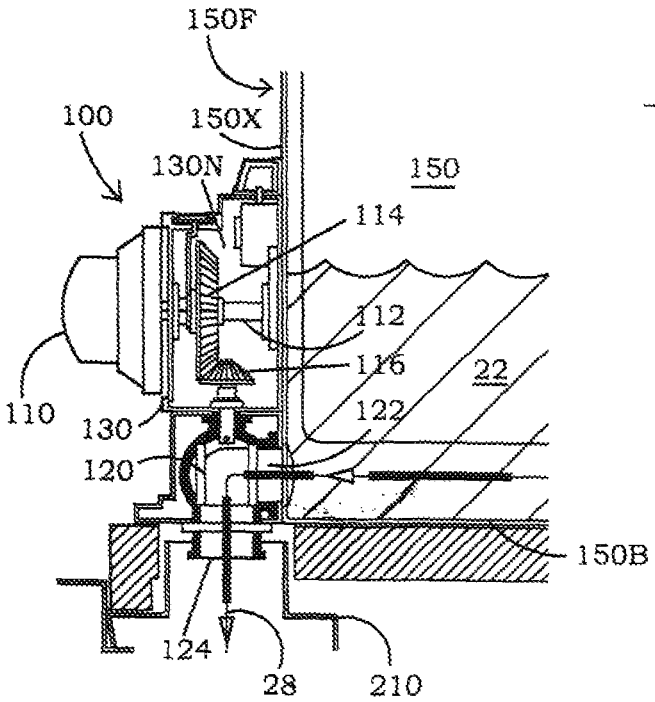
FIG. 2 is a detailed side elevational view in cross-section of a drain valve assembly of the invention.

FIG. 2 shows in detail the drainage assembly 100. The drainage assembly is attached to the stockpot, the stockpot having a front 150F and an exterior 150X, the drainage assembly 100 having a housing 130 with an inside 130N and an outside on the exterior 150X of the stockpot. Inside the housing 130 is an angle ball valve 120 having an inlet 122 and an outlet 124. The inlet 122 is connected to the stockpot 150, the stockpot having an opening at the bottom front of the stockpot for the inlet 122. The outlet is connected to the integrated funnel 210 on the burner plate. On the outside of the housing 130 is a knob 110, the knob 110 connected to a shaft 112 inside the housing 130, the shaft 112 having a vertical gear wheel 114 attached. The vertical gear wheel 114 engages a horizontal gear wheel 116. The horizontal gear wheel 116 rotates the ball valve 120, opening and closing the valve inlet 122. When the knob 110 is turned, the shaft 112 turns the large gear wheel 114, engaging the horizontal gear wheel 116 to open or close the ball valve 120. When the ball valve 120 is open, water 22 drains out of the stockpot 150 through the valve inlet 122, through the valve 120 to the outlet 124, through the integrated funnel 210 into the sink. It should be noted that cooking liquid in the stockpot may be plain water, pasta water, vegetable water, stock or broth, and all are primarily water, and included wherever water in the stockpot is mentioned as the cooking liquid in this discussion.

Figure 8:
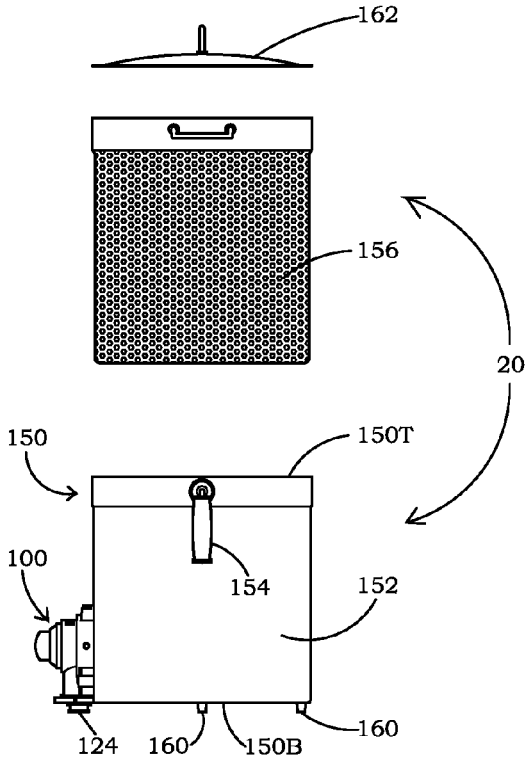
FIG. 8 is a side elevational view of the invention with a burner plate assembly, braced in an upright position.
Figure 8:
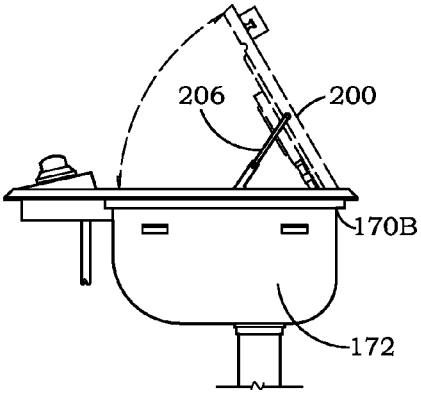

FIG. 8 shows the burner plate 200, shown in outline, in an upright position for periodic cleaning. The burner plate 200 is attached to the sink back 170B by a hinge that allows the burner plate 200 to swing upwardly, giving access to the sink body 172 for thoroughly cleaning the sink body 172. The burner plate 200 has a support rod 206 that keeps the burner plate 200 upright during the process. The rinse head assembly in the sink body 172 allows the user to rinse food residue when necessary to minimize the frequency of cleaning the sink bowl by raising the burner plate.

Figure 9A:
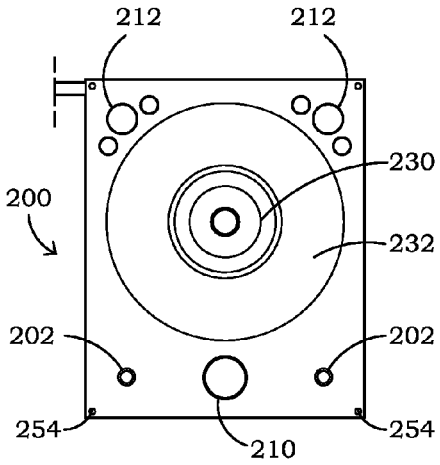
FIG. 9A is a top plan view of the burner plate assembly.
Figure 9B:
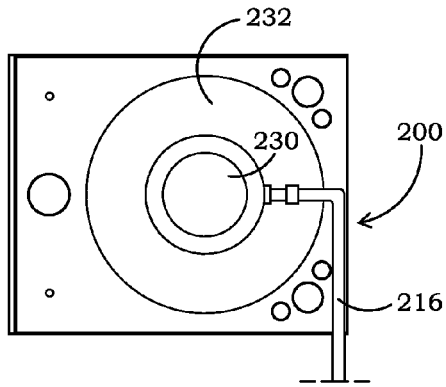
FIG. 9B is a bottom plan view of the burner plate assembly.
Figure 9C:
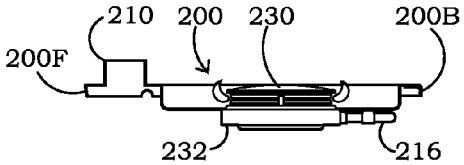
FIG. 9C is a side elevational view of the burner plate assembly, having gas as a heat source.
Figure 9D:
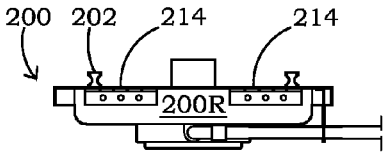
FIG. 9D is a rear elevational view of the burner plate assembly, having gas as the heat source.

FIGS. 9A-9D illustrate the burner plate in various views, the burner plate having four corners. FIG. 9A shows a top plan view of the burner plate 200, having a burner 230 in a burner well 232, a plurality of steam vents 212, a plurality of riser pins 202, a plurality of set pin sockets 254, a socket in each corner and the integrated funnel 210. The steam vents allow steam to escape from the heated liquid while it is flowing into the sink. In the bottom plan view shown in FIG. 9B, the burner plate has a heat source 216 connected to the burner 230 in the burner well 232. FIG. 9C shows a side elevation of the burner plate 200, using a gas heat source 216 as an illustration. It is understood that many varieties of heat sources are available with the cooktop, such as, for example, but not limited to electrical, natural gas, liquified propane, and cooking gas. The heat source 216 connects to the well 232 beneath the burner 230. The burner plate 200 has a front 200F and a rear 200R. At the front of the burner plate is the integrated funnel 210. FIG. 9D shows the rear elevation of the burner plate 200 with at least one hinge 214 on the rear 200R that attaches to the sink bowl. The riser pin 202 maintains space between the burner plate 200 and the grate on top of the burner plate 200 when the cooktop is assembled, allowing air to circulate around the burner as well as additionally supporting the grate.

Figure 10A:
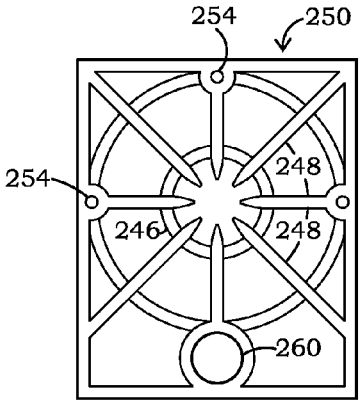
FIG. 10A is a top plan view of a grate.
Figure 10B:
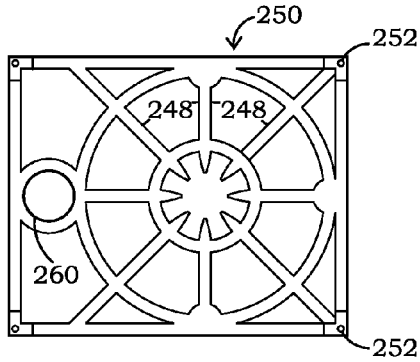
FIG. 10B is a bottom plan view of the grate.

FIG. 10A and FIG. 10B show the grate 250 with the bore 260 for the integrated funnel. The grate 250 has a plurality of stock pot supports 248 radiating from a center circle 246. FIG. 10A shows a plurality of set pin sockets 254 to receive set pins on the bottom of the stockpot to properly position the stockpot in place so that the outlet of the drainage assembly valve connects to the integrated funnel. FIG. 10B shows the grate having corners with a plurality of set pins 252, one in each corner to properly align the grate 250 with the burner plate.

Figure 11:
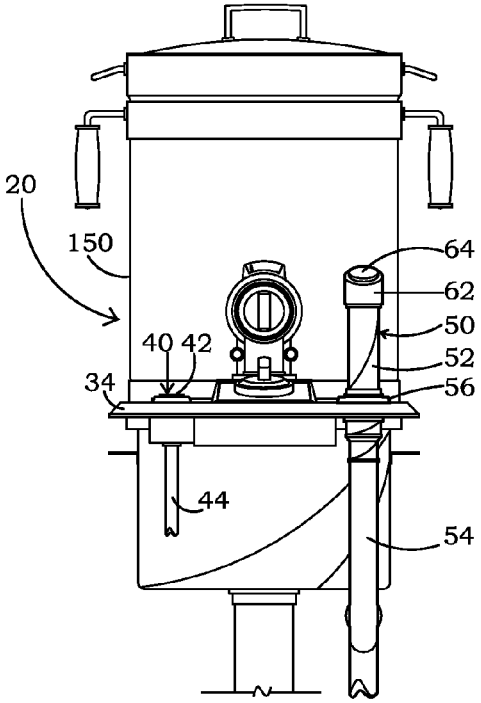
FIG. 11 is a front elevational view of a further embodiment of the invention.
Figure 12:
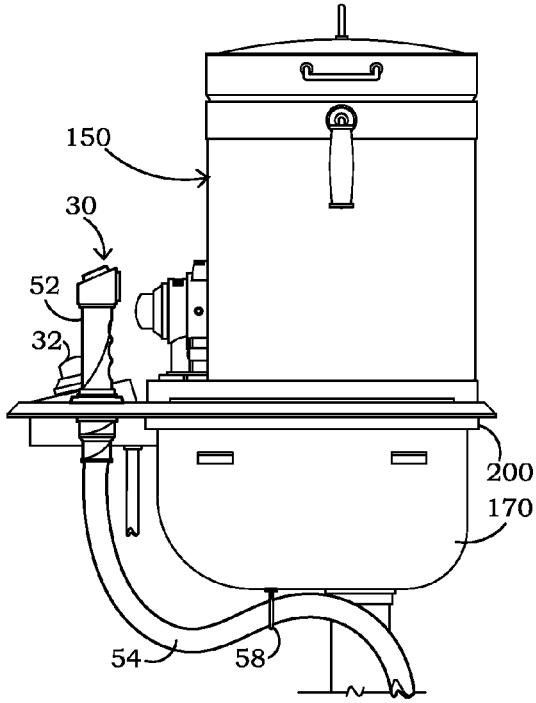
FIG. 12 is a side elevational view of the further embodiment of the invention.
Figure 13:
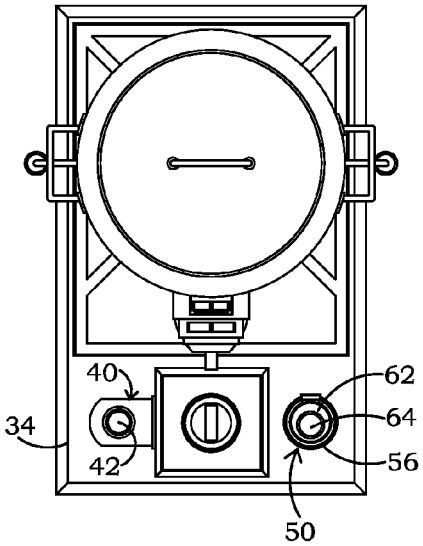
FIG. 13 is a top plan view of the further embodiment of the invention.
Figure 14:
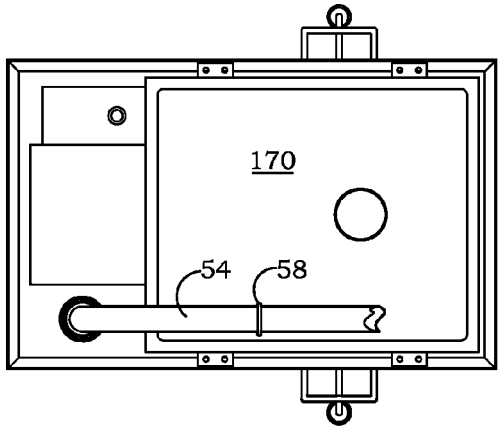
FIG. 14 is a bottom plan view of the further embodiment of the invention.

FIG. 11 shows a further embodiment of the invention 20, the cooktop drain having a pot filler assembly 50. The pot filler assembly 50 has a head 62 with an actuator 64 and nozzle, a hose 54, a grip 52, and a mount 56, the filler assembly 50 sitting in a second opening on the apron 34. The hose 54 is connected to a potable water source. The hose 54 is of sufficient length to extend above the stockpot 150 so that nozzle on the head 62 directs a spray into the stockpot 150. Illustrated in FIG. 11 is the rinse assembly 40, showing the tubing 44 supplying potable water to the rinse nozzle, the tubing connecting to an actuator 42 and the nozzle in the first opening in the apron 34. FIG. 12 shows the hand grip 52 in detail and a hose band 58 attached to the sink 170 that keeps the filler hose 54 in place but allows the hose to extend as needed. FIG. 13 is a top plan view of the further embodiment of the invention. The actuator button 64 and the spray head 62, and the mount 56 for the filler assembly 50, the actuator button 42 for the rinse assembly 40 and the burner control knob 32 are disposed on the apron 34. It is understood that the layout of the apron is not significant and that variation in the position of the control knob and actuator buttons is possible within the inventive concept. FIG. 14 is a bottom plan view of the further embodiment showing the filler hose 54 attached to the sink 54 by the hose band 58.

Figure 15:
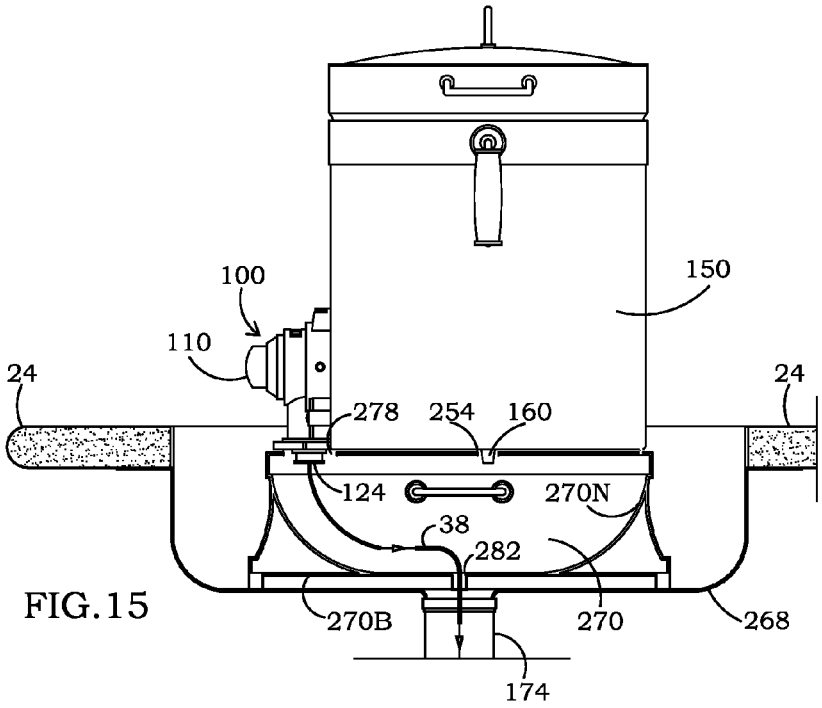
FIG. 15 is a side elevational view of a further embodiment of the invention.
Figure 16A:
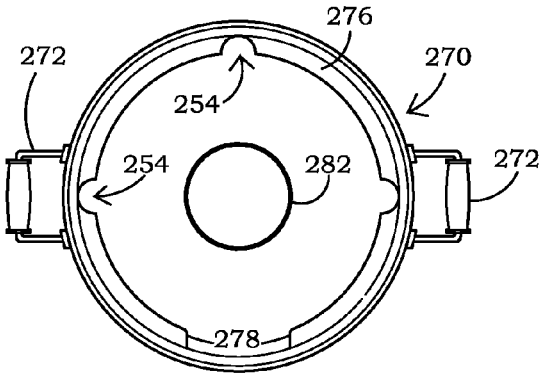
FIG. 16A is a bottom plan view of the stockpot assembly in another embodiment of the invention.
Figure 16B:
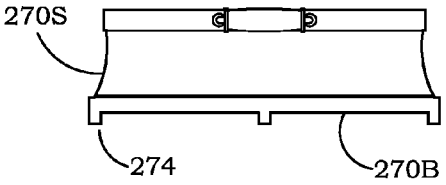
FIG. 16B is a side elevational view of a removable basin assembly in another embodiment of the invention.
Figure 16C:
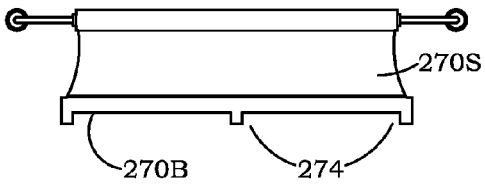
FIG. 16C is a front elevational view of the removable basin assembly in the another embodiment of the invention.

FIG. 15 shows another embodiment of the invention, wherein the draining the stockpot 150 is performed on a portable drain basin 270 without a cooktop. The portable drain basin 270 with a bottom 270B is placed inside a separate sink 268 in the countertop 24, the separate sink 268 slightly larger to accommodate the drain basin 270. The stockpot 150 with the drainage assembly 100 is placed directly on the portable drain basin 270. FIG. 16A shows a top plan view of the drain basin 270. The drain basin 270 has a top flange 276 with an opening 278 for the drainage assembly 100, a bottom drain opening 282 and sockets 254 for the set pins on the bottom of the stockpot. The drain basin 270 has a pair of handles 272 for transporting the basin 270. FIGS. 16B and 16C illustrate the plurality of feet 274 on the bottom 270B of the basin 270 that defines a space underneath the basin for water to flow. The drawings also illustrate the basin having concave sides 270S on the outside. FIG. 15 shows in cross-section the drain basin 270 having an interior wall 270N that is convex to promote the flow of water from the drainage assembly 100 on the stockpot 150. The water flows following a path 38 out of the output 124 of the drainage assembly 100 and down the convex wall 270N of the basin 270.

Figure 17A:
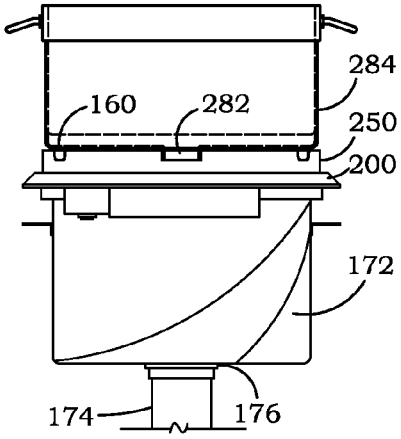
FIG. 17A is a front elevational view of a removable basin assembly in yet a further embodiment of the invention without the cooktop assembly.
Figure 17B:
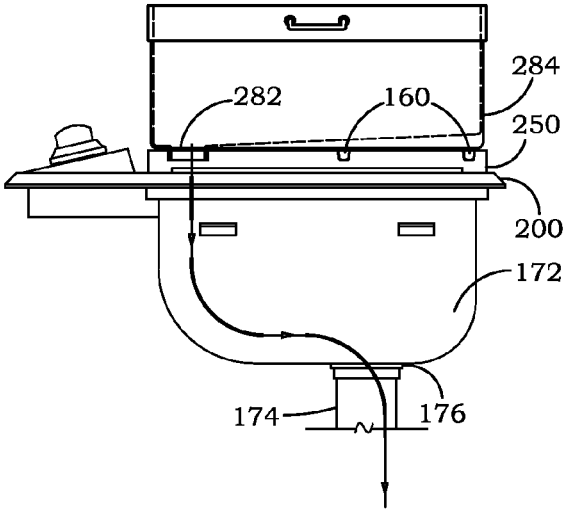
FIG. 17B is a side elevational view of the removable basin assembly in yet a further embodiment of the invention without the cooktop assembly.
Figure 17C:
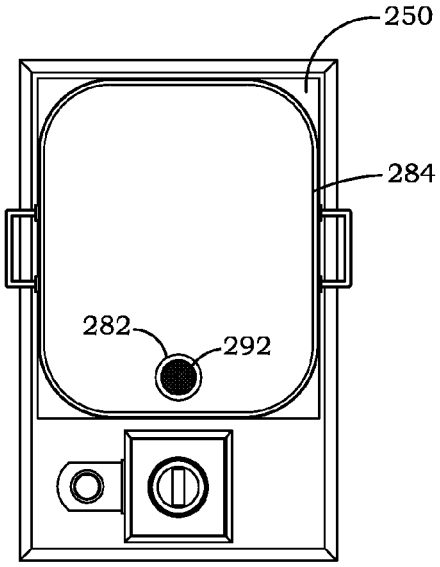
FIG. 17C is a top plan view of the removable basin assembly in yet a further embodiment of the invention without the cooktop assembly.

FIGS. 17A-17C show yet another embodiment of the invention using a temporary basin 284 on top of the grate 250 and burner plate 200. The temporary basin 284 provides the user with a temporary sink for use when the cooktop is not in use. The temporary basin 284 has a bottom, the bottom having a plurality of set pins 160 and a drain outlet 282. The drain outlet 282 is above the integrated funnel of the burner panel so that water passes through the outlet 282 and integrated funnel into the sink body and down the drain. The temporary basin 284 also has a drain stopper 292 shown in FIG. 17C. The temporary basin 284 acts as a regular sink with drainage access. When the cooktop drain has the filler assembly, the basin 284 can be filled with water and used to wash vegetables or dishes or to soak food as part of the preparation.

Referring to FIG. 8, to use the cooktop drain 20, the user lowers the burner plate 200 on the hinges at the back 170B of the sink body 172 and drops the support rod 206 into place. The user places the grate on top of the burner plate 200, placing the set pins 252 on the grate 250 as shown in FIG. 7 in the set pin sockets on the burner plate, placing the bore of the grate over the integrated funnel 210 of the burner plate 200 and resting the grate on the riser pin 202. The stockpot 150 is placed on the grate 250, placing the set pins 160 on the bottom 150B of the stock pot 150 into the set pin sockets on the grate 250 and the output 124 of the drainage assembly 100 into the integrated funnel 210, using the inverted handles 154 to rotate the stockpot 150 for proper placement. The strainer 156 or other utensil is selectively set in the stockpot 150 and the user covers the stockpot 150 with the lid 162.

When the user is ready to cook using the stockpot 150 on the cooktop drain 20, the user fills the stockpot 150 with water or other cooking liquid. In one embodiment, as illustrated in FIG. 12, the user fills the stockpot 150 with potable water from the pot filler assembly 50. The user turns on the heat source in the burner plate 200, by turning the burner control knob 32 to a desired setting. When the user is finished cooking, the user turns off the heat source with the burner control knob 32. Referring to FIG. 2, when the user is ready to discard the hot liquid 22 in the stockpot 150, the user turns the knob 110 on the drainage assembly 100 to open the valve 120 in the drainage assembly 100 that connects the inlet 122 on the bottom 150B of the stockpot 150 to the valve 120, allowing the liquid 22 to flow through the valve 120, through the output 124 into the integrated funnel 210 following the path 28 into the sink body and down through the drain opening into the drain pipe. Referring to FIG. 1, to clean any food residue left in the sink body 172, the user pushes the rinse assembly actuator on the apron 34 and the rinse spray nozzle 48 washes any residue down the drain opening 176. In the embodiment with the pot filler assembly, the user can further rinse down the stockpot with the pot filler and thereby having a complete clean-in-place (CIP) system. If there is no pot filler, the stockpot 150 is removed and cleaned conventionally. The cooktop drain 20 is ready for additional use.

In yet another embodiment, as illustrated in FIGS. 17A-17C, the user replaces the stockpot with a temporary basin 284, aligning the set pins 160 on the bottom of the basin with the set pins sockets on the grate and the drain with the integrated funnel on the burner plate. The user uses the basin conventionally, and when ready to drain the basin 284, opens the plug 292 to the integrated funnel, allowing the water to flow down the basin 284 into the sink body 172 and down the drain opening 176. The user washes any residue down the drain pipe 174 by pressing the actuator on the rinse assembly, shown in other drawings, to rinse the sides of the sink body 172. When the user is ready to cook with the cooktop drain 20, the user replaces the stockpot on the grate 200 after removing the temporary basin 284 and aligns the stockpot on the grate as described hereinabove.

In another embodiment, illustrated in FIG. 15, if the cooktop drain is not available for draining the stockpot 150, the user removes the stockpot from the grate. The user places the stockpot 150 on the removable basin 270 either prior to or immediately after the removable basin 270 is place in a conventional sink 268. The user aligns the set pins 160 with the set pin openings 254 and the drainage assembly output 124 with the opening 278 in the flange on the removable basin 270. To empty the stockpot 150, the user turns the drainage assembly knob 110, opening the ball valve, allowing the path 38 of water through the input on the bottom of the stockpot into the ball valve and down the output 124 into the removable basin 270. The liquid flows to the drain base opening 282 and out the basin 270 into the conventional sink 268 and down the drain pipe 174. When the user wishes to use the cooktop drain, the user replaces the stockpot on the grate as described hereinabove.

In conclusion, herein is presented a drain, having a cooktop and a valved stockpot and a sink connected to the drain, the sink having a rinse assembly. The sink, cooktop and stockpot are assembled such that heating, draining the stockpot of water into the sink and rinsing the sink of residue are performed by a single apparatus. The invention is illustrated by example in the drawing figures, and throughout the written description. It should be understood that numerous variations are possible, while adhering to the inventive concept. Such variations are contemplated as being a part of the present invention.

What is claimed is:

1. A cooktop drain for cooking food in a heated liquid, draining the heated liquid and rinsing food residue remaining from the heated liquid, comprising:

a front apron;

a sink having a top and having a drain to a sanitary sewer system;

a stockpot for containing and cooking food in the liquid, having a bottom portion with a valve inlet and a drainage assembly connected to the inlet, the drainage assembly having a valve and an outlet for discharging the heated liquid and a means for opening said valve to direct the liquid from the valve inlet through the valve to the valve outlet;

a grate with a bore, the grate substantially level with the sink top, the stockpot resting on the grate;

a burner plate, having a burner with a heat source, the burner sitting below the grate, the grate sitting on the burner plate, the burner plate having an integrated funnel, the integrated funnel connecting to the valve outlet through the bore of the grate, liquid from the stockpot directed through said bore into the sink, bypassing the burner and heat source; and a rinse assembly, the rinse assembly inside the sink connected to a potable water source, having a spray nozzle operative for spraying water, said spray nozzle having an actuator button to actuate the spray nozzle of the rinse assembly, the actuator button on the front apron, the rinse assembly rinsing food residue after the heated liquid drains from the stockpot through the drainage assembly on the burner plate, bypassing the burner and heat source, the heated liquid and food residue flowing down the drain.

2. The cooktop drain as described in claim 1, wherein the apron has a pot filler assembly, the pot filler assembly having a hose with a spray nozzle, the hose connected to a potable water source, and the pot filler having an actuator, the actuator controlling the release of potable water, the pot filler assembly providing potable water to the stockpot when the actuator releases potable water through the spray nozzle into the stockpot.

3. The cooktop drain as described in claim 1, wherein the stockpot has a front exterior and the drainage assembly is attached to the front exterior, the drainage assembly having a knob on the front exterior of the stockpot to open the valve to direct the liquid from the valve inlet through the valve to the valve outlet.

4. The cooktop drain as described in claim 1, wherein the stockpot is replaced with a removable basin, the removable basin having a bottom with a front, the front bottom having a drain with a drain stopper, the drain connecting to the integrated funnel on the burner assembly, the basin sitting on the grate, creating a second sink that drains through the integrated funnel into the sink when the stopper is selectively removed to open the drain.

5. The cooktop drain as described in claim 1, wherein the stockpot is removed from the grate and placed on a portable drain base, the portable drain base having a flange to support the stockpot, the flange having an opening for the drainage assembly, the drain base have a bottom opening, the drain base sitting in a second sink with a drain, the bottom opening over the drain, the drainage assembly aligned with the opening in the flange, the stock pot draining the heated liquid into the portable drain base through the drainage assembly into the second sink, flowing out the drain in the second sink, draining the stockpot without tipping.

6. A cooktop drain for cooking food in a heated liquid, and draining the heated liquid, comprising:

a front apron;

a sink having a drain to a sanitary sewer system set in a countertop, the countertop having a cutout for the sink;

a stockpot for containing and cooking food in the liquid, having a bottom portion with a valve inlet and a drainage assembly connected to the inlet, the drainage assembly having a valve and an outlet for discharging the heated liquid and a means for opening the valve to direct the liquid from the valve inlet through the valve to the valve outlet;

a grate with a bore, the grate level with the countertop, the stockpot resting on the grate; and a burner plate, having a burner with a heat source, the burner sitting below the grate, the grate sitting on the burner plate, the burner plate having an integrated funnel, the integrated funnel connecting to the valve outlet through the bore of the grate, liquid from the stockpot directed through said bore into the sink, bypassing the burner and heat source; and a rinse assembly, the rinse assembly inside the sink and connecting to a potable water source, the rinse assembly having a spray nozzle and an actuator button to actuate the spray nozzle of the rinse assembly to spray water, the rinse assembly rinsing food residue after the heated liquid drains from the stockpot through the drainage assembly bypassing the integrated funnel on the burner plate, bypassing the burner and heat source, the heated liquid and food residue flowing down the drain in the sink.

7. The cooktop drain as described in claim 6, wherein the apron has a pot filler assembly, the pot filler assembly having a hose with a spray nozzle, the hose connected to a potable water source, and the pot filler having an actuator, the actuator controlling the release of potable water, the pot filler assembly providing potable water to the stockpot when the actuator releases potable water through the spray nozzle into the stockpot.

8. The cooktop drain as described in claim 6, wherein the stockpot has an front exterior and the drainage assembly is attached to the front exterior, the drainage assembly having a knob on the front exterior of the stockpot to open the valve to direct the liquid from the valve inlet through the valve to the valve outlet.

9. A method cooking food in a heated liquid and draining the heated liquid using a cooktop drain having a sink with a top and a drain, a stockpot with a side drainage assembly in a bottom portion, the drainage assembly having a valve with an inlet and an outlet, a grate with a bore, the stockpot sitting on the grate, a burner plate with a burner connected to a heat source and an integrated funnel, the burner plate and grate at the top of the sink, the integrated funnel connecting the outlet of the valve through the bore in the grate to the sink, bypassing the burner, the cooktop drain having a pot filler assembly, the pot filler assembly having a nozzle and a hose connected to potable water, comprising:

filling the stockpot with potable water using the pot filler assembly by extending the hose such that the nozzle of the pot filler assembly directs potable water into the stockpot;

cooking the food in the liquid in the stockpot with heat provide by the burner; and draining the heated liquid in the stockpot by opening the valve in the drainage assembly, allowing the heated liquid to drain through the valve inlet into the valve and out the valve outlet into the integrated funnel, bypassing the burner and flowing directly into the sink and out the drain.

* * * * *